US006726407B1

(12) United States Patent
Steinkamp et al.

(10) Patent No.: US 6,726,407 B1
(45) Date of Patent: Apr. 27, 2004

(54) RETRACTABLE RADOME STRAKE AND METHOD

(75) Inventors: Jeffrey H. Steinkamp, Quincy, IL (US); James Butts, Casco, ME (US)

(73) Assignee: SPX Corporation, Charlotte, NC (US)

( * ) Notice: Subject to any disclaimer, the term of this patent is extended or adjusted under 35 U.S.C. 154(b) by 0 days.

(21) Appl. No.: 10/283,202

(22) Filed: Oct. 30, 2002

(51) Int. Cl.[7] ..... F15D 1/10; H01Q 1/42
(52) U.S. Cl. ..... 405/211; 114/243; 343/872
(58) Field of Search ..... 405/211, 216; 114/243; 343/872

(56) References Cited

U.S. PATENT DOCUMENTS 3,440,991 A * 4/1969 Cubbage ..... 114/243
3,975,980 A * 8/1976 Hood ..... 87/6
4,084,065 A * 4/1978 Swenson ..... 174/70 R
4,347,036 A * 8/1982 Arnold ..... 416/1
5,901,925 A * 5/1999 McGrath et al. ..... 244/45 A
5,986,618 A * 11/1999 Aakula et al. ..... 343/872
2003/0007839 A1 * 1/2003 Brown ..... 405/211

* cited by examiner

*Primary Examiner*—Robert E. Pezzuto
*Assistant Examiner*—Tara L. Mayo
(74) *Attorney, Agent, or Firm*—Baker & Hostetler LLP

(57) ABSTRACT

A retractable radome strake is provided that includes an assembly of finger elements. The assembly of finger elements, when coupled to a radome, deflect at wind speeds greater than approximately twenty mph or wind pressures greater than approximately one psf. Accordingly, the retractable radome strake does not unnecessarily contribute to the wind load of a radome enclosed antenna structure when the strakes are not needed.

23 Claims, 3 Drawing Sheets

RETRACTABLE RADOME STRAKE AND METHOD

FIELD OF THE INVENTION

The present invention relates generally to methods and devices for reducing vortex shedding. More particularly, the present invention is directed to a retractable strake for reducing the susceptibility of a radome to vortex shedding.

BACKGROUND OF THE INVENTION

It is well known that antenna structures are subject to vortex shedding. Vortex shedding refers to the phenomenon that occurs when wind forces exert a pressure of one level on one side of an object, while exerting a pressure of another level on an opposite side of the object.

For example, an antenna structure is typically surrounded by a radome. A radome is a hollow cylindrical mast, typically made from fiberglass, that is placed around an antenna structure to protect it from elements, such as snow and ice, that could affect the performance of the antenna. When a radome enclosed antenna structure is erected and subjected to wind, the wind flows around the circumference of the radome.

As shown in FIG. 1, when wind 10 flows around the radome 12, vortices 14, 16, 18 may are be created, which, although occurring after the wind has traversed the radome 12, still exert pressure on the radome 12. Vortices are swirling eddies of air which occur as the flow separates from the trailing surface of the radome. As the flow separates or "sheds" a negative pressure is developed. The band of negative pressure essentially wraps around the down stream side of the radome from separation point to separation point. This together with the positive pressure from the impingent flow forms the basis for flow induced drag. The frequency of the shedding vortices is dependent on the kinematic viscosity of the fluid (in this case air), the wind speed, and the geometry of the object. The frequency of vortex shedding can be either random or periodic.

Antenna structures are designed to withstand established maximum expected wind speeds as the local and national standards dictate. The antenna structures are designed to withstand the expected maximum wind speeds, which are measured from a reference point location at or near ground level, occurring over a given time period of fifty years or so. Typically, the maximum wind speeds are in excess of seventy miles per hour (mph). However, the actual resulting wind pressure at a location along the antenna structure is scaled up (i.e., increases) as one traverses from the bottom of the antenna structure to the top of the antenna structure to account for the increase in wind speed that occurs as with the increased height of the structure.

Vortex shedding frequencies are either random or significantly higher than any of the potentially damaging modes of structural vibration at points along the antenna, which are susceptible to higher wind speeds. The greatest problem occurs at low wind speeds, i.e., at or near the bottom of the antenna structure. The frequency of vortex shedding is periodic at low wind speeds. A vortex will shed off of one side and then the other at regular intervals, producing a periodic oscillating side to side force. This can be damaging if the frequency of vortex shedding is slightly above the first structural mode and the wind speed driving the structure is greater than ten mph. This will cause resonance, a condition where there is very little resistance to oscillatory motion. Large displacements can develop causing damage or failure.

The vortices 14, 16, 18 are spiraling circles of wind that tend to increase the pressure exerted on the radome.

When the pressure on one side of a structure differs from the pressure on the opposite side of the structure, at a point in time, the structure may move in a direction toward the side that is lower in pressure. As the wind traverses the structure, the pressure exerted on opposite sides of the structure may continue to fluctuate, and cause the structure to vibrate, i.e., sway in response to the alternating low pressure sides. For example, as shown in FIG. 1, vortex 14 will cause radome 12 to move downward, while vortex 16 will cause the radome 12 to move upward.

Conventionally, helical strakes, which are blade-like structures, are added to the external surface of the top thirty percent of a radome to prevent wind induced vortex shedding. The strakes disrupt and diffuse the flow of wind around the radome, such that the development of periodic vortices, which may cause the antenna structure to resonate, is reduced.

Typically, radome enclosed antenna structures, such as a television broadcasting antennas, experience vortex shedding at wind speeds in the range of ten to twenty miles mph and/or at wind pressures at or below one pound per square foot (psf). Thus, strakes are mostly needed at wind speeds below approximately twenty miles per hour and/or wind pressures below one psf.

However, the addition of the strakes to a radome increases the cross-sectional area of the radome. With the increase in the cross-sectional area, the radome is susceptible to greater wind loads, that could affect the stability of the antenna. Thus, components of the antenna structure, such as an antenna mast and a supporting tower structure, have to be built stronger to withstand the increased wind loads. As a result of the added strakes, the cost to manufacture the antenna structure increases.

Accordingly, it would be desirable to provide a strake that may reduce the susceptibility of antenna structures to vortex shedding, while reducing the contribution of the strake to the wind load of the antenna structure.

Further, it would be desirable to provide a strake that helps to prevent vortex shedding without significantly increasing the costs of associated antenna structures, such as antenna masts and supporting tower structures.

SUMMARY OF THE INVENTION

In one aspect of the present invention, a system for reducing vortex shedding on an object is provided that includes a strake having a plurality of finger elements, wherein the strake is coupled to the object.

In another aspect of the present invention, the strake deflects at wind pressures greater than approximately one psf.

In another aspect of the present invention, the maximum height of the strake is ten percent of an overall diameter of the object.

In another aspect of the present invention, the finger elements are bristle elements.

In another aspect of the present invention, the finger elements are plastic strips.

In another aspect of the present invention, the plastic strips are made from polycarbonate.

In another aspect of the present invention, the object includes a port, and at least one of the assembly elements extends through the port.

In another aspect of the present invention, a base is provided, and the plurality of finger elements is coupled to the base.

In another aspect of the present invention, the strake is one of a plurality of strakes that is positioned about the object.

In another aspect of the present invention, the plurality of strakes is positioned in a helical type of pattern about the object.

In another aspect of the present invention, the strake is molded into the object.

In yet another aspect of the present invention, an apparatus for reducing vortex shedding on an object is provided that includes a means for assembling a plurality of finger elements, and a means for positioning the assembly of finger elements about an object. The positioning means allows the plurality of finger elements to deflect when at least one of wind speeds are greater than approximately twenty mph and wind pressures are greater than approximately one psf.

In another aspect of the present invention, the plurality of finger elements is a strake.

In another aspect of the present invention, the assembling means is a support structure that is coupled to the plurality of finger elements.

In another aspect of the present invention, a support structure is coupled to the plurality of finger elements, and the support structure is also coupled to the object via non-metallic hardware.

In another aspect of the present invention, the positioning means is an adhesive.

In another aspect of the present invention, the adhesive is an epoxy.

In another aspect of the present invention, the object is a radome.

In another aspect of the present invention, the object is a chimney.

Further, in yet another aspect of the present invention, a method for manufacturing an apparatus for reducing vortex shedding on an object is provided that includes arranging a plurality of finger elements into an assembly of finger elements, and coupling the assembly of finger elements to an object, such that the assembly of finger elements deflects when at least one of wind speeds are greater than approximately twenty mph and wind pressures are greater than approximately one psf.

There has thus been outlined, rather broadly, the more important features of the invention in order that the detailed description thereof that follows may be better understood, and in order that the present contribution to the art may be better appreciated. There are, of course, additional features of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF THE PREFERRED EMBODIMENTS OF THE INVENTION

Figure 2:
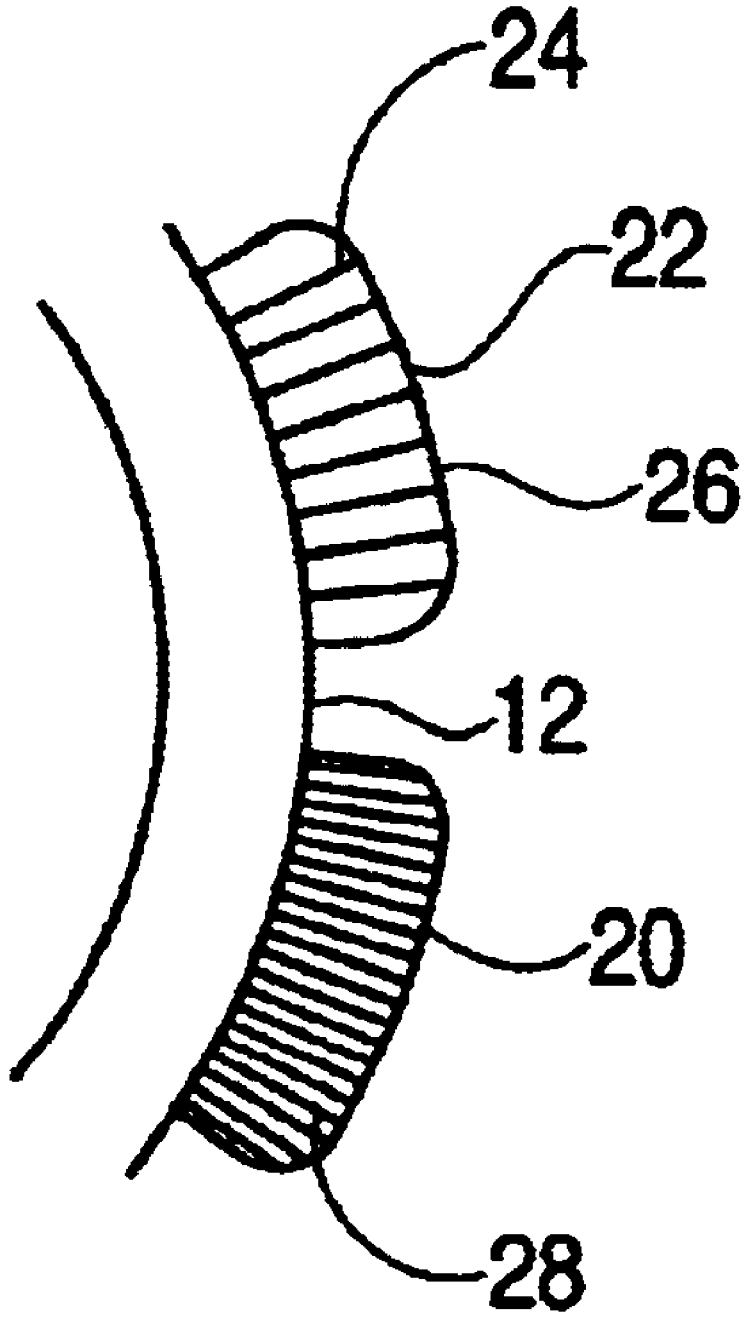
FIG. 2 is a top view of a retractable strake in accordance with the present invention.

Referring now to the figures, wherein like reference numerals indicate like elements, there is shown in FIG. 2, a retractable strake 20, 22 in accordance with the present invention, that may be utilized to reduce vortex shedding. For purposes of example, the present invention is described with respect to a radome 12. However it should be understood by one of ordinary skill in the art that a strake 20, 22 in accordance with the present invention may have other applications.

In a preferred embodiment of the present invention, the strake 20, 22 is constructed from an assembly of finger elements 24, 26, 28. In the preferred embodiment of the present invention, the individual finger elements 24, 26, 28 are bristle elements manufactured from a non-metallic material, for example, a plastic, a nylon material, or a polyethylene material. In another exemplary embodiment of the present invention, the finger elements 24, 26, 28 are formed from strips of a plastic material, for example polyethylene.

It should be understood by one of ordinary skill in the art that a strake 20, 22, when utilized in connection with an antenna system, is made from a non-metallic material to prevent interference with the transmission of signals from the antenna. However, a strake 20, 22 of the present invention, when utilized for other applications, such as preventing the occurrence of vortex shedding on, for example, metal chimney stacks, may be manufactured from a metallic or a non-metallic material.

Shown in FIG. 2, the assembly of finger elements 24, 26, 28 are arranged according to a predetermined pattern. The pattern is designed such that the maximum height of the assembly of finger elements 24, 26, 28 is approximately ten percent of the overall diameter of the radome 12. In an exemplary embodiment of the present invention, the diameter of the radome 12 is forty inches and the maximum height of the assembly of finger elements is approximately four inches.

In the preferred embodiment of the present invention, at least one side of the assembly of finger elements 24, 26, 28 is curved, such that the strake 20, 22 can be curvedly positioned about the radome 12.

Figure 3:
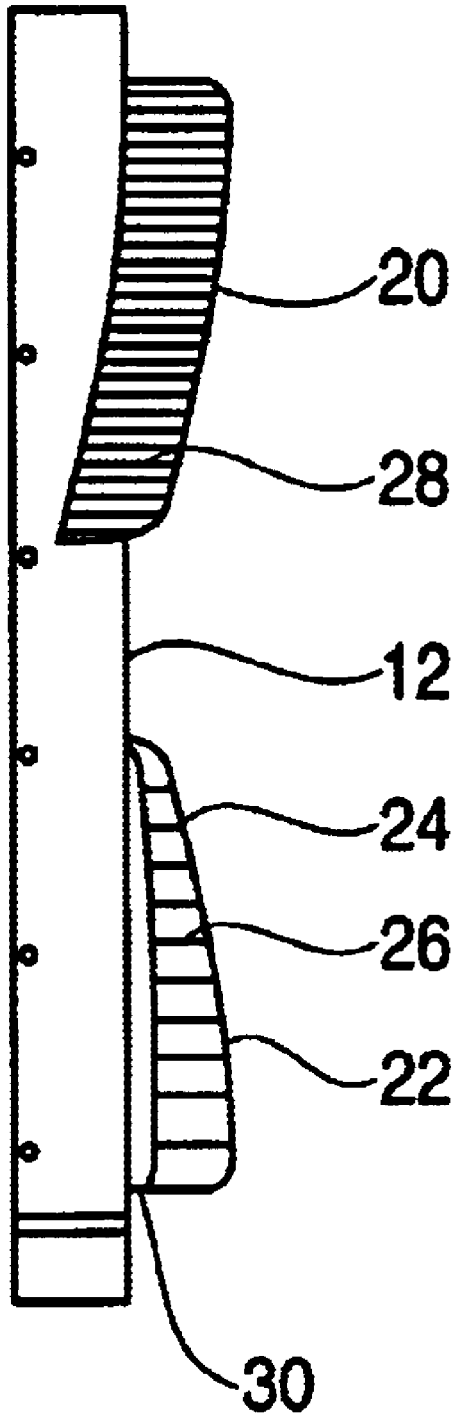
FIG. 3 is a front elevation view of a retractable strake in accordance with the present invention.

Shown in FIG. 3, strakes 20, 22, in accordance with present invention, are positioned on an exterior surface of a radome 12. In a preferred embodiment of the present invention, the strakes 20, 22 are positioned about the exterior surface of the radome, such that they form a helical or nearly helical pattern about the exterior surface of the radome.

Figure 1:
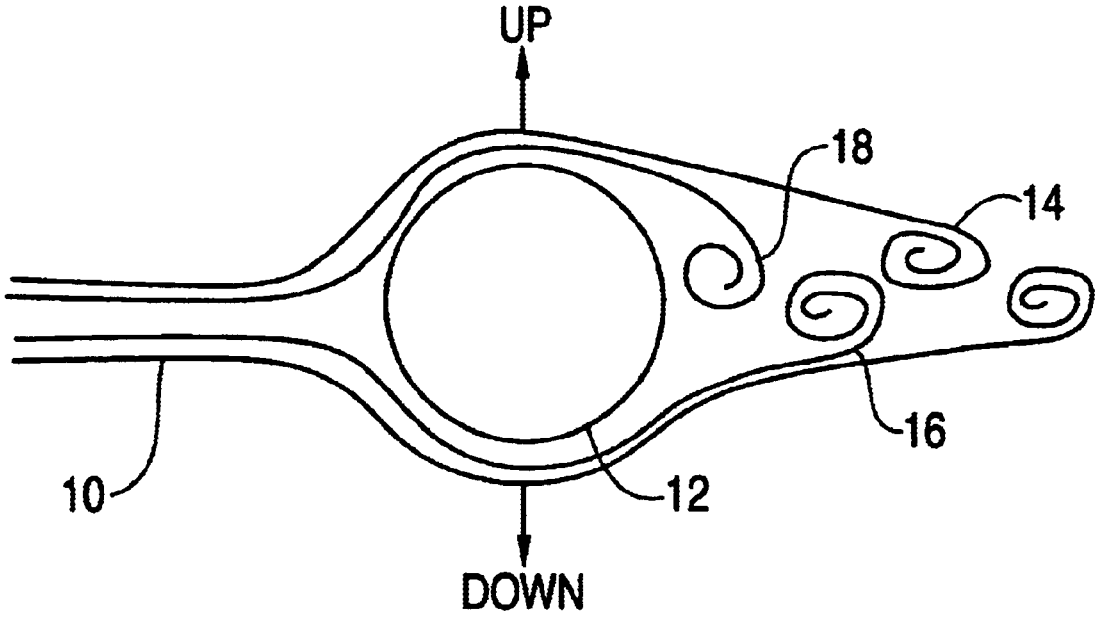
FIG. 1 (PRIOR ART)
FIG. 1 illustrates a radome subjected to vortex shedding.

By positioning the strakes 20, 22 in a helical type of pattern about the radome 22, instead of straight out from the radome 12, the strakes 20, 22 cover more surface area of the radome 12, and are able to diffuse the wind flow, and prevent the development of vortices, such as vortices 14, 16, 18 shown in FIG. 1.

During operation, a strake 20, 22, in accordance with the present invention, is retractable. For example, at wind speeds of approximately twenty mph or less and/or wind pressures of approximately one pound psf or less, when vortex shedding typically occurs, the strake 20, 22 is erect, stiff and/or stable. Accordingly, the strake 20, 22 creates the necessary turbulence to avoid the development of vortices that could affect the stability of, for example, a radome enclosed antenna structure.

However, the strake 20, 22 is designed such that, at wind speeds above approximately twenty mph and/or wind pressures greater than approximately one psf, when vortex shedding typically does not occur, the strake 20, 22 deflects in the direction of airflow, as the wind speeds and/or wind pressures increase. Thus, the cross-sectional area of the radome 12, with the added strake, decreases. Accordingly, the amount of wind load that the radome 12 is susceptible to also decreases. The deflection serves to retract the strake.

In an exemplary embodiment of the present invention, at wind speeds of approximately twenty miles per hour, and/or wind pressures of twelve and one-half psf, the assembly finger elements 24, 26, 28 of a strake 20, 22 completely deflect, and lay along the surface of the radome 12.

In a preferred embodiment of the present invention, a strake 20, 22 is coupled to the radome via an adhesive. In an exemplary embodiment of the present invention the radome 12 has openings/ports through which the finger elements 24, 26, 28 are inserted, and secured with adhesive, such as an epoxy. In a second exemplary embodiment of the present invention, the individual finger elements 24, 26, 28, of a strake 20, 22, are secured to the exterior surface of the radome 12 with an adhesive.

In a third exemplary embodiment of the present invention, a strake 20, 22 is assembled on a non-metallic support structure and/or base 30 that is molded into the structure of the radome 12, or coupled to the radome 12 with a non-metallic hardware. In a fourth exemplary embodiment of the present invention, the strake 20, 22 is assembled within a non-metallic frame structure that is coupled to the radome 12 with non-metallic hardware. It should be understood by one of ordinary skill in the art that there may be various other methods for coupling the strake 20, 22 to a radome 12.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A system for reducing vortex shedding on an object, comprising:

a strake having a plurality of finger elements; wherein the strake is attached to the object, and wherein a maximum height of the strake is ten percent of an overall diameter of the object.

2. The system of claim 1, wherein the strake deflects at wind pressures greater than approximately one psf.

3. The system of claim 1, wherein the strake deflects at wind speeds greater than approximately twenty mph.

4. The system of claim 1, wherein the finger elements are bristle elements.

5. The system of claim 1, wherein the finger elements are plastic strips.

6. The system of claim 1, wherein the plastic strips are made from polycarbonate.

7. The system of claim 1, further comprising a port, wherein at least one of the assembly of finger elements extends through the port.

8. The system of claim 1, further comprising a base, wherein the plurality of finger elements are coupled to the base.

9. The system of claim 1, wherein the strake is one of a plurality of strakes positioned about the object.

10. The system of claim 9, wherein the plurality of strakes are positioned in a helical type of pattern about the object.

11. The system of claim 1, wherein the strake is molded into the object.

12. The system of claim 1, wherein the strake is attached to the object by adhesive.

13. The system of claim 1, wherein the object is a radome.

14. An apparatus for reducing vortex shedding on an object, comprising:

means for assembling a plurality of finger elements; and means for assembling a plurality of finger elements, wherein a maximum height of the plurality of finger elements is ten percent of an overall diameter of the object; and means for positioning the assembly of finger elements about the object, such that the positioning means allows the plurality of finger elements to deflect when at least one of wind speeds are greater than approximately twenty mph and wind pressures are greater than approximately one psf.

15. The apparatus of claim 14, wherein the plurality of finger elements is a strake.

16. The apparatus of claim 14, wherein the assembling means is a support structure that is coupled to the plurality of finger elements.

17. The apparatus of claim 16, wherein the support structure couples to the object via non-metallic hardware.

18. The apparatus of claim 14, wherein the positioning means is an adhesive.

19. The apparatus of claim 18, wherein the adhesive is an epoxy.

20. The apparatus of claim 14, wherein the object is a radome.

21. The apparatus of claim 14, wherein the object is a chimney.

22. The apparatus of claim 14, wherein the object is a radome.

23. A method for manufacturing an apparatus for reducing vortex shedding on an object, comprising:

arranging a plurality of finger elements into an assembly of finger elements, wherein a maximum height to the assembly of finger elements is ten percent of an overall diameter of the object; and coupling the assembly of finger elements to the object, such that the assembly of finger elements deflects when at least one of wind speeds are greater than approximately twenty mph and wind pressures are greater than one psf.

* * * * *

UNITED STATES PATENT AND TRADEMARK OFFICE

CERTIFICATE OF CORRECTION

PATENT NO. : 6,726,407 B1
DATED : April 27, 2004
INVENTOR(S) : Jeffrey H. Steinkamp It is certified that error appears in the above-identified patent and that said Letters Patent is hereby corrected as shown below:

Column 6,
Line 52, insert -- The method of claim 23, wherein the object is a radome. --

Signed and Sealed this

Thirteenth Day of July, 2004

JON W. DUDAS
*Acting Director of the United States Patent and Trademark Office*